US009913522B1

(12) United States Patent
Greenstone

(10) Patent No.: US 9,913,522 B1
(45) Date of Patent: Mar. 13, 2018

(54) NAIL CUTTING DEVICE

(71) Applicant: Robert Bruce Greenstone, Los Angeles, CA (US)

(72) Inventor: Robert Bruce Greenstone, Los Angeles, CA (US)

( * ) Notice: Subject to any disclaimer, the term of this patent is extended or adjusted under 35 U.S.C. 154(b) by 1 day.

(21) Appl. No.: 15/254,154

(22) Filed: Sep. 1, 2016

(51) Int. Cl.

| | |
|---|---|
| ***B25B 23/18*** | (2006.01) |
| ***A45D 29/02*** | (2006.01) |
| ***F21L 4/00*** | (2006.01) |
| ***F21V 23/04*** | (2006.01) |
| ***F21V 23/00*** | (2015.01) |
| ***A45D 29/04*** | (2006.01) |
| ***F21V 33/00*** | (2006.01) |

(52) U.S. Cl.
CPC ..... *A45D 29/02* (2013.01); *A45D 29/04* (2013.01); *F21L 4/00* (2013.01); *F21V 23/001* (2013.01); *F21V 23/0414* (2013.01); *F21V 33/0084* (2013.01)

(58) Field of Classification Search
USPC ..... 362/119, 120
See application file for complete search history.

(56) References Cited

U.S. PATENT DOCUMENTS

| | | | | |
|---|---|---|---|---|
| 9,266,223 | B2 * | 2/2016 | Hoang | B25B 7/12 |
| 2002/0178585 | A1 * | 12/2002 | Yang | A45D 29/02 30/28 |
| 2006/0158871 | A1 * | 7/2006 | Hopkins | A01K 13/00 362/119 |

* cited by examiner

*Primary Examiner* — Vip Patel
(74) *Attorney, Agent, or Firm* — Douglas E. Warren

(57) ABSTRACT

A nail cutting device is shown that includes a rotatable cutting portion that is in a substantially fixed relationship with a rotatable illuminating element to allow the nail cutting device to provide illumination onto a nail that is being cut or shaped.

17 Claims, 5 Drawing Sheets

NAIL CUTTING DEVICE

CROSS REFERENCE TO RELATED APPLICATIONS

Not applicable.

STATEMENT REGARDING FEDERALLY SPONSORED RESEARCH

Not Applicable.

BACKGROUND OF THE INVENTION

Personal grooming includes the trimming and cutting of finger nails and toe nails. Although that task sounds simple, the actual cutting and trimming of toe nails and finger nails into a specific desired shape and length can be problematic. The general ergonomics and mechanics of the human body can sometimes present obstacles to the person who wishes to position nail clippers as just the right angle to a finger or toe nail to achieve the desired clipping result. Additionally, there can be certain medical problems that can limit or even prevent a person from using nail clippers at all because the range of movement of the person is inhibited by the medical condition. Even the onset of old age can simply make the joints of a person have a smaller range of movement. Also, there are often situations where the nail cutter can be placed into position near a nail, but the cutting process cannot be completed because the cutting portion of the nail clipper is not facing the correct position in relation to the nail itself.

In yet other circumstances a person may be able to maneuver nail clippers near the correct position for cutting and trimming, but not be able to place the clippers into the exact final position because there is insufficient lighting to illuminate the nail being cut such that the person can properly place the nail clipper into position for cutting and trimming. This can result in improper cutting and trimming of the nails that can generate medical issues such as ingrown nails or wounded skin accidently cut during the nail trimming process.

As a result of these several issues, it can be very difficult to complete the process of trimming and shaping the nails of a user when using the nail clippers currently found in the art. It would be desirable to have a nail cutting device that can provide additional maneuverability of the cutting portion of the nail cutter while also providing illumination to the nail being cut to ensure the nail is being cut and trimmed in the desired manner.

SUMMARY OF THE INVENTION

This section provides a general summary of the disclosure, and is not a comprehensive disclosure of its full scope or all of its features.

In accordance with the various embodiments of the present invention, this invention relates to a uniquely design nail clipping device that provides an adjustable clipping portion that can be rotated in relation to the nail clipper handle to allow the clipper portion to be properly position for cutting a nail, while also providing illumination at the point where the clipping of the nail is to be executed such that the nail and the clipper can be readily positioned for cutting the nail. To be sure the illumination is being provided onto the proper location, the illuminating element and the cutting portion of certain preferred embodiments of the present invention are in a fixed relationship such that any rotating movement of the cutting portion will cause the illuminating portion to rotate in coordination and commensurately with the cutting portion.

DESCRIPTION OF THE DRAWINGS

In the accompanying drawings which form part of the specification.

Corresponding reference numerals indicate corresponding steps or parts throughout the several figures of the drawings.

Figure 1:
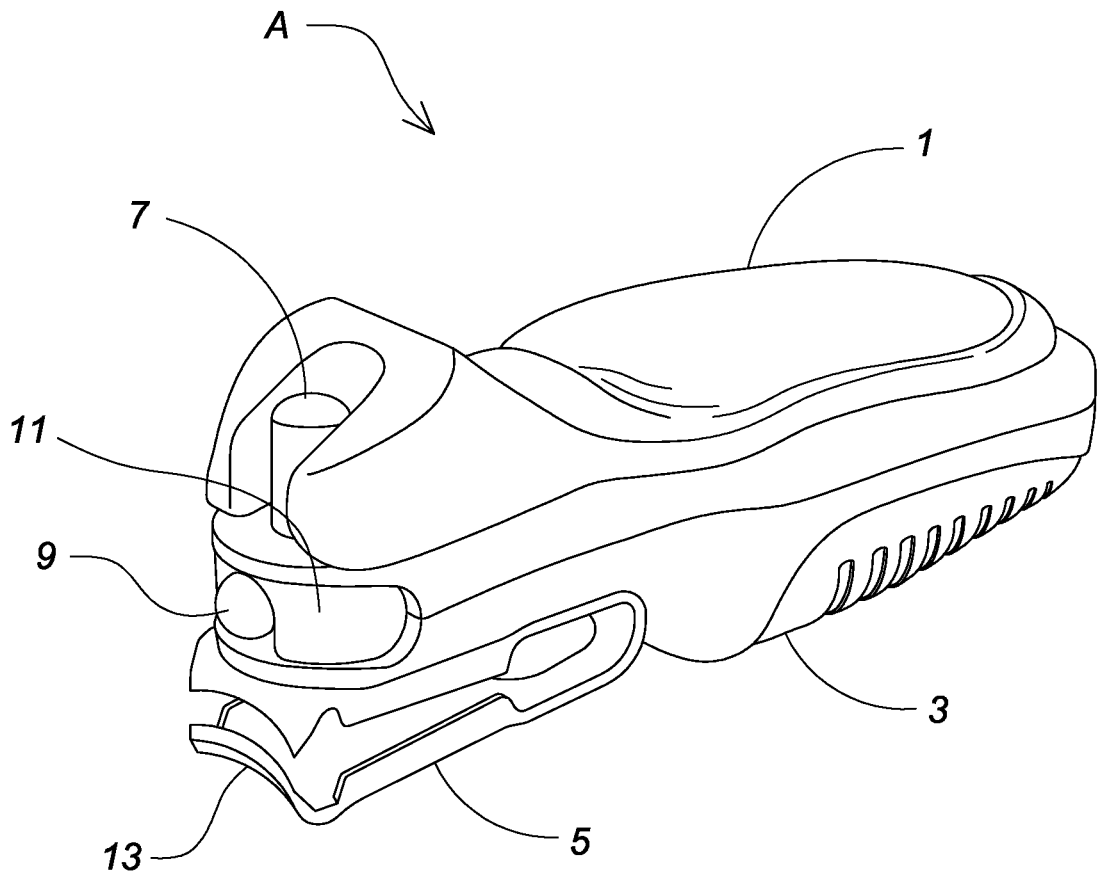
FIG. 1 is a perspective view of one embodiment of the present invention.

While specific embodiments of the present invention are illustrated in the above referenced drawings and in the following description, it is understood that the embodiments shown are merely some examples of various preferred embodiments and are offered for the purpose of illustration only, and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF AT LEAST ONE PREFERRED EMBODIMENT OF THE INVENTION

In the following description, numerous specific details are set forth such as examples of some preferred embodiments, specific components, devices, and methods, in order to provide a thorough understanding of embodiments of the present disclosure. It will be apparent to a person of ordinary skill in the art that these specific details need not be exclusively employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill.

At least one preferred embodiment of the present invention is illustrated in the drawings and figures contained within this specification. More specifically, certain preferred embodiments of the present invention are generally disclosed and described in FIGS. 1-5.

Referring now to FIG. 1, one embodiment of the present invention of a Nail Clipping Device A is shown. In this embodiment the Nail Clipping Device A generally includes a handle 1, a base 3, a cutting portion 5, a shaft 7, an illuminating element 9, and a holder 11.

Figure 2:
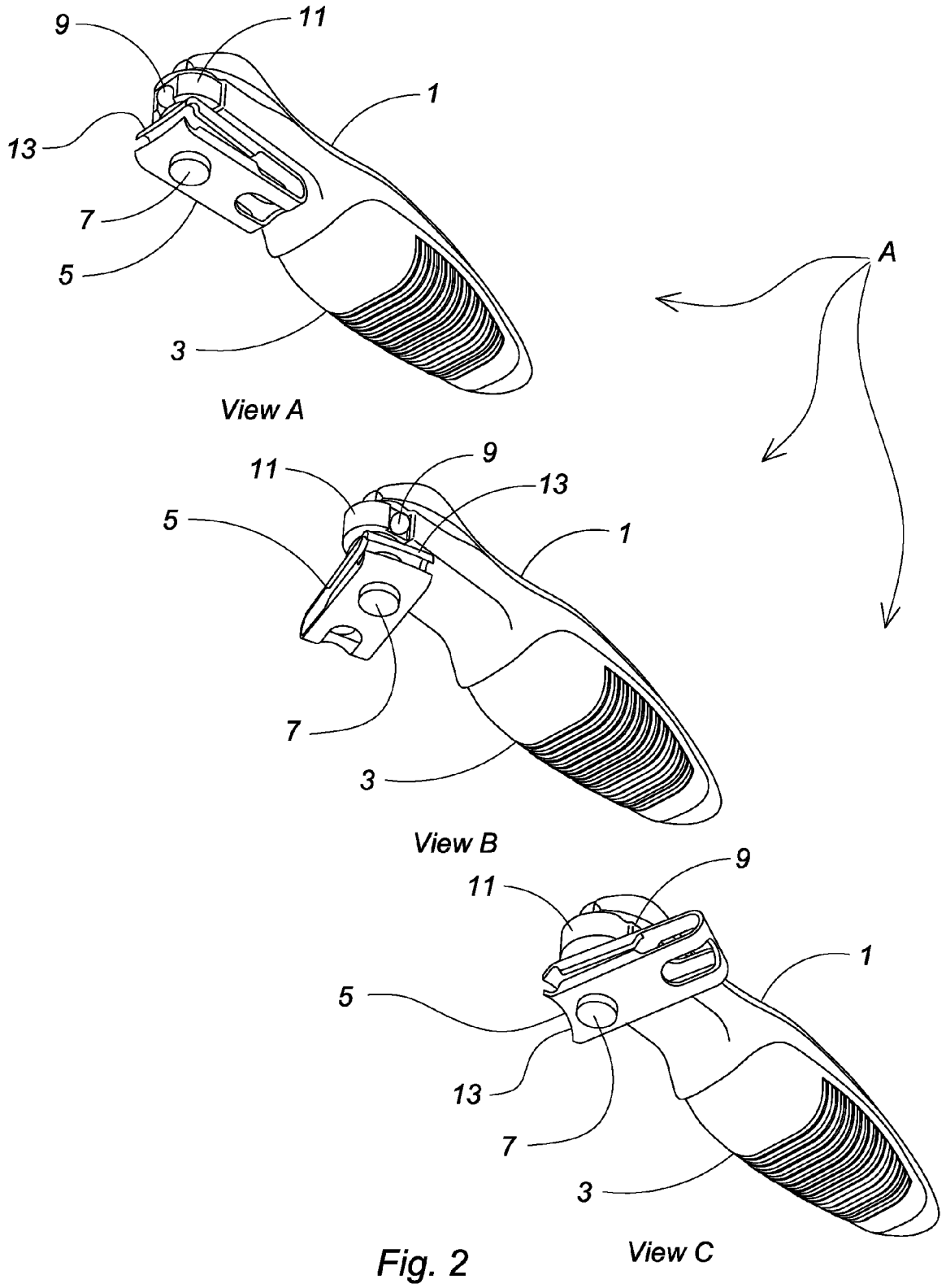
FIG. 2 is a bottom perspective view of one embodiment of the present invention showing the rotating action of the cutting portion and the illumination element.

FIG. 2 shows the rotating capability of the cutting portion 5 and the illuminating element 9 of one embodiment of the present invention. More specifically, the cutting portion 5 of this embodiment can be horizontally rotated into a position within a range of about 150 degrees. This rotation allows the clipping portion 5 to be positioned to place the blades 13 in relation to the nail being cut such that the nail can be cut or trimmed in the desired manner and shape. It is understood that the cutting portion 5 swivels around the shaft 7. In View A of FIG. 2 the cutting portion 5 is horizontally positioned in a generally forward position to place the blades 13 in general alignment with the longitudinal axis of the Nail Cutting Device A. In View B the cutting portion 5 is horizontally positioned to place the blades 13 at angle of about 75 degrees to the right in relation to the longitudinal axis of the Nail Cutting Device A. In View C the cutting portion 5 is horizontally positioned to place the blades 13 at angle of about 75 degrees to the left in relation to the longitudinal axis of the Nail Cutting Device A. It will be appreciated by those of skill in the art that angle of rotation of the cutting portion can be at any angle in relation to the longitudinal axis of the Nail Cutting Device A and still remain within the intended scope of the present invention.

It is noted that the illuminating element 9 as shown in the views of FIG. 2 also swivels in relation to the longitudinal axis of the Nail Cutting Device A. In fact, it is understood that the illuminating element 9 coincides and is related to the swiveling action of the cutting portion 5. This ensures that the illuminating element 9 in the present embodiment can provide illumination at the point where the blades 13 of the cutting portion 5 are nearing the nail to be cut and shaped. In this way the user of the Nail Cutting Device A will always be able to see where the blades 13 are located and how the blades are oriented in relation to the nail being cut before the user operates the Nail Cutting Device A to cut and shape the associated nail.

The cutting portion 5 (FIG. 3) in the present embodiment is made of a semi-rigid metal material. In a preferred embodiment the cutting portion 5 is made from a stainless steel material. The cutting portion 5 has a general channel shape in which the blades 13 are on a distal end 15 of the channel and the proximate end 17 of the channel is generally U-shaped. It is understood that the design, shape, and material selected for the cutting portion 5 results in the proximate end 17 of the cutting portion having a bias that tends to increase the distance between the upper blade 19 and the lower blade 21 of the cutting portion when the handle 1 is not exerting an upward pulling action on the shaft 7, while also allowing the distance between the upper blade and the lower blade to be decreased thus allowing the blades to come together to pinch and cut off a portion of the nail disposed between the upper blade and the lower blade.

Figure 3:
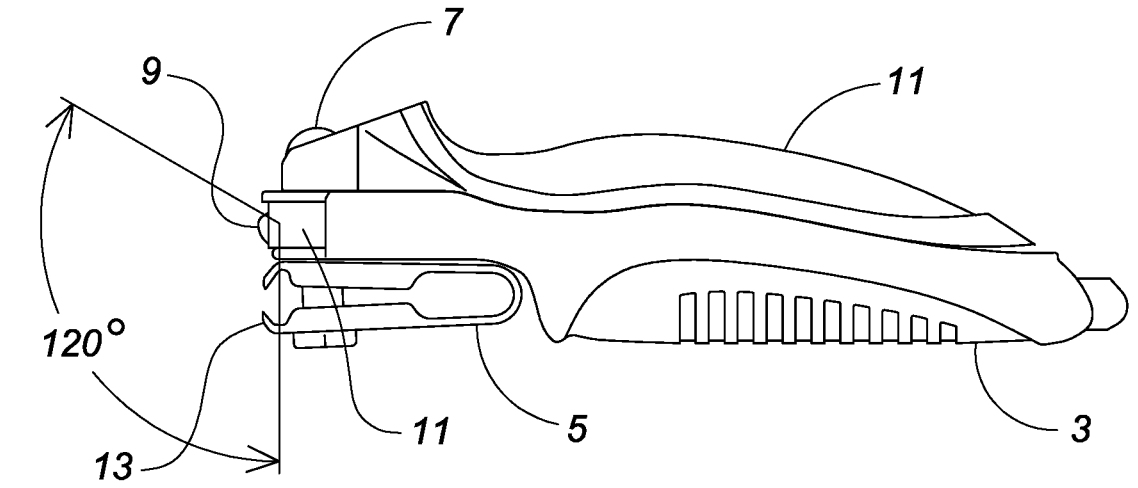
FIG. 3 is a side section view of one embodiment of the present invention showing the intended vertical and horizontal coverage of the illuminating element.
Figure 3:
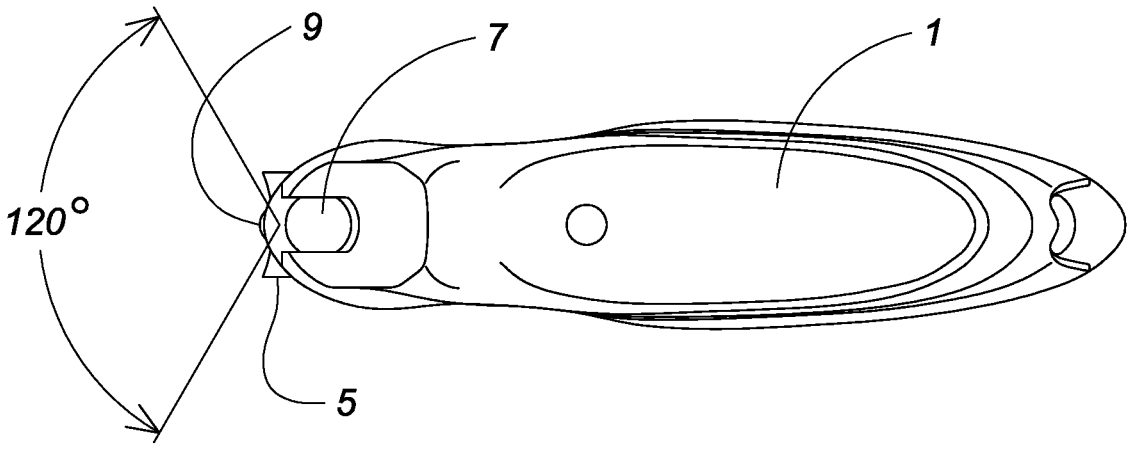

FIG. 3 also discloses the intended area of illumination to be provided by the illuminating element 9 of the present invention. More specifically, the upper view of FIG. 3 shows that the illuminating element 9 provides about 120 degrees vertical illumination while the lower view of FIG. 3 shows the illuminating element provides about 120 degrees of horizontal illumination. It will be appreciated that the amount of vertical and horizontal illumination to be provided by the illuminating element 9 can be adjusted for any specific application and still remain within the intended scope of the present invention.

Figure 4:
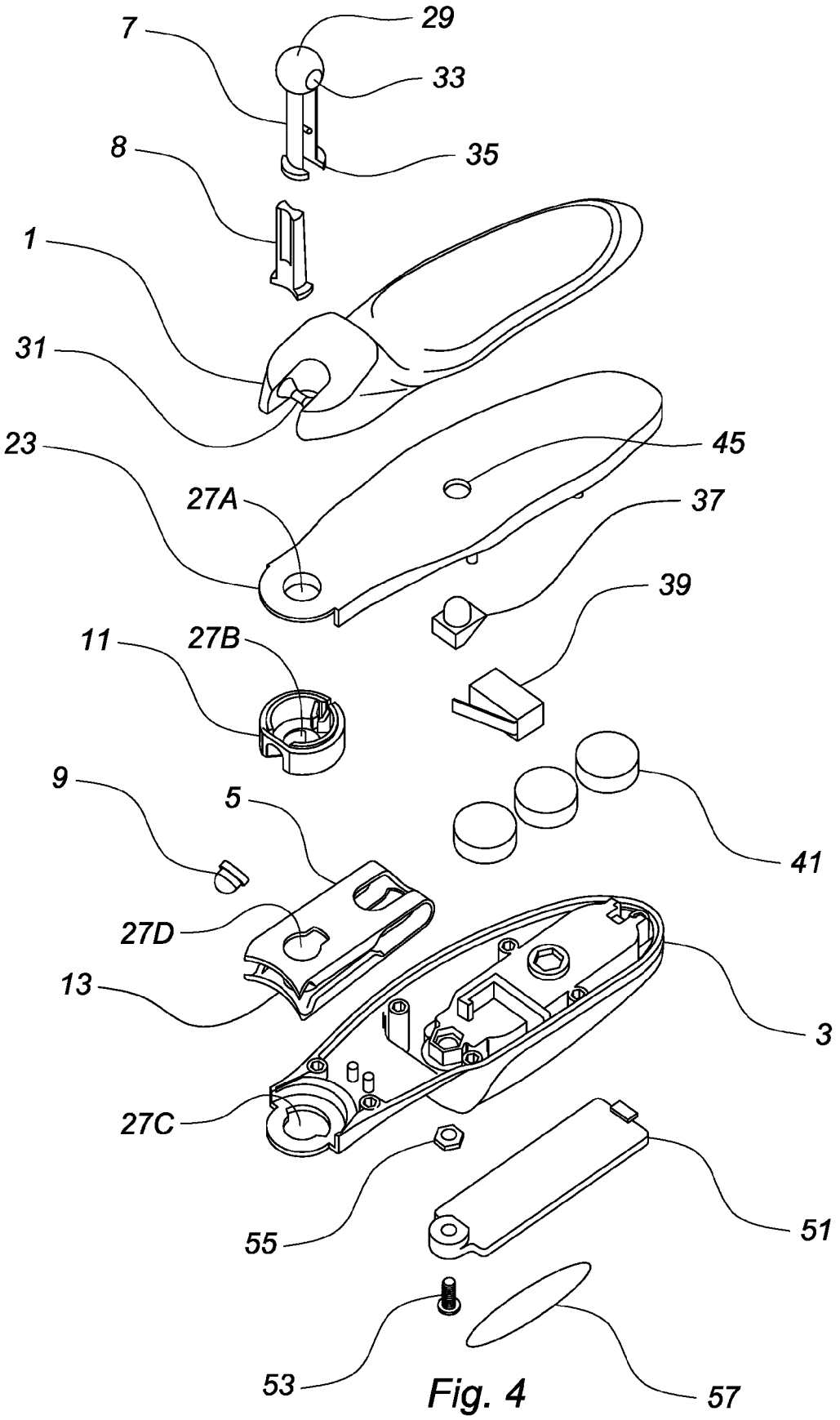
FIG. 4 is an exploded view of one embodiment of the present invention.

An exploded view of the present embodiment of the Nail Cutting Device A is shown in FIG. 4. This exploded view provides a general indication of the positioning of the various elements of the present embodiment.

More specifically, the handle 1, an upper base 23, the holder 11, the cutting portion 5 and the base 3 are held together by the shaft 7. It is understood that during assembly of the present embodiment, the handle 1, the upper base 23, the holder 11, the cutting portion 13, and the base 3 are positioned such that the openings 27A through 27D are axially aligned, and then the shaft 7 is inserted upward into the opening 27D of the cutting portion until a top shaft portion 29 of the shaft 7 nears a retention axle 31 of the handle 1. The retention axle 31 is then inserted into a retention notch 33 of the handle 1 and the spring loading bias of the material of the cutting portion 13 pulls a lower base 35 of the shaft 7 against the cutting portion to thereby captivate the handle 1, the upper base 23, the holder 11, the base 3, and the cutting portion 13 into a single sub-assembly.

Figure 5:
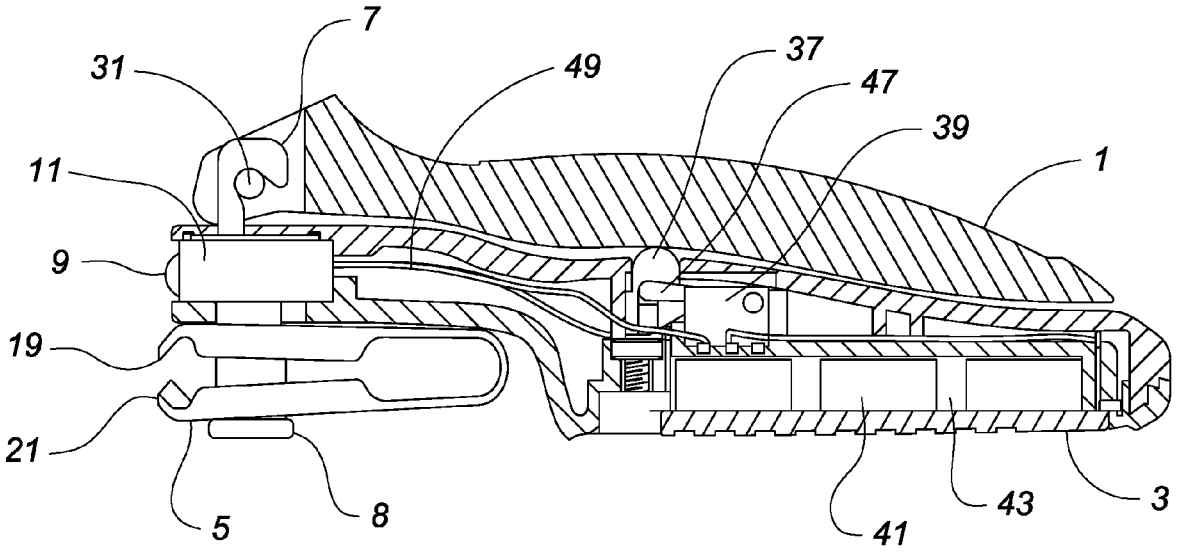
FIG. 5 is a side section view of one embodiment of the present invention.

FIG. 4 and FIG. 5 show the placement of an activation button 37, micro switch 39, and a set of batteries 41 within an internal storage area 43 of the base 3. In the present embodiment the set of batteries 41 includes three 3 lithium batteries. In yet other embodiments other types of batteries may also be used and still fall within the intended scope of the present invention.

The activation button 37 protrudes through a button opening 45 of the upper base 23 and when the handle 1 is in its stored position, the activation button is depressed downward against an activation arm 47 of the micro switch 39. It is understood that the micro switch 39 is in a normally closed position and that the position is changed to an open position by the activation button 37 when the handle 1, in its stored position, depresses the activation button against the activation arm 47. This allows the illuminating element 9 to be in operation only when the handle 1 is not pushing against the activation button 37, but allows the illuminating element to operate and provide illumination when the handle is positioned in its upward operating position during use of the Nail Cutting Device A.

FIG. 5 shows a set of internal wiring 49 that interconnects the illuminating element 9, the micro switch 39, and the set of batteries 41. It is understood that the set of internal wiring 49 is connected to provide for the functioning of the illuminating element as described above.

To retain the components within the internal storage area 43 a cover 51 is attached to the base 3 with a fastener 53 and nut 55. When the fastener 53 is installed through the cover 51, a pivotable nail file 57 is pivotally captivated by the fastener.

In operation, the handle 1 is lifted from the upper base 23 and then rotated about 180 degrees. Lifting the handle 1 activates the illuminating element 9 by permitting the activation button 37 to extend upward above the surface of the upper base 23 and allow the activation arm 47 of the micro switch 39 to complete the electrical circuit and provide electrical power to the illuminating element. To clip a nail, the cutting portion 5 is then rotated into the positioned as desired until the nail to be trimmed or shaped is disposed between the upper blade 19 and the lower blade 21 of the cutting portion 5 and the handle 1 is depressed to cut off a portion of the nail.

In the present embodiment, the overall width of the Nail Cutting Device is about 33 mm and the overall length is about 28.5 mm and the handle 1, the upper base 23, the holder 11, the base 3, and the cover 51 are made from a plastic based material. It will be appreciated, however, but hose of skill in the art that the dimensions and the base material of the elements of the various embodiments of the Nail Cutting Device A can be modified and adjusted to fit the specific requirements of any particular applications and still remain within the scope of the present invention.

In the preceding description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill. The scope of the invention should be determined by any appended claims and their legal equivalents, rather than by the examples given.

Additionally, it will be seen in the above disclosure that several of the intended purposes of the invention are achieved, and other advantageous and useful results are attained. As various changes could be made in the above constructions without departing from the scope of the invention, it is intended that all matter contained in the above descriptions or shown in the accompanying drawings shall be interpreted as illustrative and not in a limiting sense.

Terms such as "proximate," "distal," "upper," "lower," "inner," "outer," "inwardly," "outwardly," "exterior," "interior," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It will also be understood that when an element is referred to as being "operatively connected," "connected," "coupled," "engaged," or "engageable" to and/or with another element, it can be directly connected, coupled, engaged, engageable to and/or with the other element or intervening elements may be present. In contrast, when an element is referred to as being "directly connected," "directly coupled," "directly engaged," or "directly engageable" to another element, there are no intervening elements present. Other words used to describe the relationship between elements should be interpreted in a like fashion (e.g., "between" versus "directly between," "adjacent" versus "directly adjacent," etc.).

What is claimed is:

1. A nail clipping device comprising:

a base upon which a handle, an upper base, a horizontally rotatable holder, a horizontally rotatable cutting portion are disposed into position with a shaft, wherein the cutting portion and the holder are in a substantially fixed relationship such that horizontal rotation of the cutting portion will be matched by a commensurate horizontal rotation of the holder;

an illuminating element disposed and fixed within the holder such that illuminating element generally faces the same direction as a set of cutting blades of the cutting portion; and a set of batteries and a set of internal wiring that are operationally interconnected with the illuminating element, an activation button, and a micro switch for operating the illuminating element.

2. The nail clipper of claim 1 further comprising an activation arm operatively connected to the micro switch wherein the activation arm is repositioned when the handle releases the activation button to complete an electrical circuit that causes the illuminating element to illuminate when the handle is disposed into an operating position away from the activating button.

3. The nail clipper of claim 2 wherein the cutting portion the cutting portion swivels around the shaft.

4. The nail clipper of claim 3 wherein the cutting portion is horizontally adjustable and can be rotated into a position within a range of about 150 degrees.

5. The nail clipper of claim 4 wherein the cutting portion is horizontally positionable to place the blades at angle of at least one of either about 75 degrees to the right or to the left in relation to the longitudinal axis of the nail cutting device.

6. The nail clipper of claim 5 wherein the illuminating element provides about 120 degrees vertical illumination and about 120 degrees of horizontal illumination.

7. The nail clipper of claim 6 wherein the activation button protrudes through a button opening in the upper base such that when the handle is in a stored position, the activation button is depressed downward against the activation arm of the micro switch interrupt a electrical circuit of the micro switch to turn off the illuminating element.

8. The nail clipper of claim 7 wherein the activation button is allowed to protrude further from the button opening in the base when the handle is in an operating position such that the activation arm is allowed to move upward to complete the electrical circuit of the of the micro switch to turn on the illuminating element.

9. The nail clipper of claim 8 further comprising an internal storage area inside the base that contains a set of batteries and a set of internal wiring to provide electrical current to the micro switch and the illuminating element.

10. The nail clipper of claim 9 wherein the set of batteries is a set of lithium batteries.

11. The nail clipper of claim 10 further comprising a cover to protect the components within the internal storage area wherein the cover is attached to the base with a fastener.

12. The nail clipper of claim 11 further comprising a pivotable nail file that is pivotally captivated by the fastener.

13. The nail clipper of claim 12 wherein the handle, the upper base, the horizontally rotatable holder, the base, and the cover are made from a plastic based material.

14. The nail clipper of claim 13 the overall width of the nail cutting device is about 33 mm and the overall length of the nail cutting device is about 28.5 mm.

15. The nail clipper of claim 14 wherein the cutting portion 5 is made of a semi-rigid metal material.

16. The nail clipper of claim 15 wherein the cutting portion is made of a stainless steel material.

17. A nail clipping device comprising:

a base upon which a handle, an upper base, a horizontally rotatable holder, a horizontally rotatable cutting portion are disposed into position with a shaft, wherein the cutting portion and the horizontally rotatable holder are in a substantially fixed relationship such that horizontal rotation of the cutting portion will be matched by a commensurate horizontal rotation of the horizontally rotatable holder, and wherein the cutting portion the cutting portion swivels around the shaft and is horizontally adjustable to be rotated into a position within a range of about 150 degrees;

an illuminating element disposed and fixed within the horizontally rotatable holder such that illumination element generally faces the same direction as a set of cutting blades of the cutting portion and wherein the illuminating element provides about 120 degrees vertical illumination and about 120 degrees of horizontal illumination;

a set of lithium batteries and a set of internal wiring are placed within an internal storage area and which are operationally interconnected with the illuminating element, an activation button, and a micro switch for operating the illuminating element; and a cover to protect the components within the internal storage area wherein the cover is attached to the base with a fastener that also captivates a pivotable nail file.

* * * * *